US011585077B2

(12) United States Patent
Price

(10) Patent No.: US 11,585,077 B2
(45) Date of Patent: Feb. 21, 2023

(54) VACUUM BREAKER VALVE WITH LEAK PROTECTION

(71) Applicant: Anderson Brass Company, Hartsville, SC (US)

(72) Inventor: Bryan Curtiss Price, Chesterfield, SC (US)

(73) Assignee: Anderson Brass Company, Hartsville, SC (US)

( * ) Notice: Subject to any disclaimer, the term of this patent is extended or adjusted under 35 U.S.C. 154(b) by 49 days.

(21) Appl. No.: 17/347,771

(22) Filed: Jun. 15, 2021

(65) Prior Publication Data

US 2022/0056680 A1 Feb. 24, 2022

Related U.S. Application Data

(60) Provisional application No. 63/067,562, filed on Aug. 19, 2020.

(51) Int. Cl.
*E03C 1/10* (2006.01)

(52) U.S. Cl.
CPC ..... *E03C 1/108* (2013.01); *E03C 1/104* (2013.01)

(58) Field of Classification Search
CPC ..... E03C 1/108; E03C 1/104
See application file for complete search history.

(56) References Cited

U.S. PATENT DOCUMENTS

| | | | | |
|---|---|---|---|---|
| 5,125,429 | A | 6/1992 | Ackroyd et al. | |
| 5,372,158 | A | 12/1994 | Berfield | |
| 5,937,889 | A | 8/1999 | Krieg | |
| 6,123,095 | A | 9/2000 | Kersten et al. | |
| 6,904,931 | B2 | 6/2005 | Stephens | |
| 7,013,910 | B2 | 3/2006 | Tripp | |
| 8,297,300 | B2 | 10/2012 | Bejerano | |
| 9,637,899 | B2 | 5/2017 | Ping et al. | |
| 9,719,235 | B1 * | 8/2017 | Huang | E03B 7/12 |
| 9,719,606 | B1 | 8/2017 | Yang | |
| 10,273,670 | B2 | 4/2019 | Yontz | |
| 2006/0272706 | A1 | 12/2006 | Chung | |

FOREIGN PATENT DOCUMENTS

| | | | |
|---|---|---|---|
| CN | 103062453 | A | 4/2013 |
| JP | 2004301326 | A | 10/2004 |

* cited by examiner

*Primary Examiner* — Kevin R Barss
(74) *Attorney, Agent, or Firm* — Dority & Manning, P.A.

(57) ABSTRACT

A vacuum breaker valve assembly includes valve body defining a hollow main chamber, which communicates with a plenum opening, an inlet opening, and an outlet opening. A valve cap is attached to the valve body and defines a plenum, which communicates with the plenum opening, and a vent opening communicating with atmosphere. A drainage plug is connected to the vent opening, and an overflow conduit defines an elongated flexible hollow tube having one end connected to the drainage plug. A cap fixture is connected to the valve cap and defines a countersunk shallow recess that receives therein a thin label that is adhesively attached to the cap fixture.

8 Claims, 5 Drawing Sheets

VACUUM BREAKER VALVE WITH LEAK PROTECTION

CROSS-REFERENCE TO RELATED APPLICATIONS

The present application claims the benefit of U.S. Provisional Application No. 63/067,562, filed Aug. 19, 2020.

STATEMENT REGARDING FEDERALLY SPONSORED RESEARCH OR DEVELOPMENT

Not applicable.

FIELD OF THE INVENTION

The subject matter disclosed herein generally involves a valve that typically is installed between the black water storage tank of a recreational vehicle and the connection to a clean water source that supplies clean water for flushing the black water storage tank.

BACKGROUND OF THE INVENTION

U.S. Pat. No. 8,297,300 to Bejerano, which patent is hereby incorporated herein by this reference for all purposes, schematically discloses in its Prior Art FIG. 1 an example of a vacuum breaker valve 10 that is configured to discharge backflow spillage into the environment immediately surrounding the valve 10 via an atmospheric vent 16. Normal inflow enters the valve via inlet 12, pushes the disc valve 22 (also known as the "float" for reasons shortly to become apparent) upward on a vertical valve stem 24 until the upper vent seal 28, which is carried on the disc valve 22, engages the corresponding vent seat to seal off the inflow from escaping via the atmospheric vent 16. The inflow then proceeds during normal operation of the valve 10 to exit via the outlet 14. Without the incoming pressure of the inflow, the disc valve 22 drops downward on the vertical valve stem 24 until the valve seal 26 engages the valve seat 18 to prevent backflow through the outlet 14 from entering the inlet 12. However, the backflow can escape from the valve 10 via the atmospheric vent 16 and thence into the environment surrounding the valve 10.

Recreational vehicles have a black water tank that receives liquid from toilets. Referring to Bejerano FIG. 1 mentioned above, these black water tanks would be connected to the outlet 14 of the vacuum breaker valve 10 and must be emptied periodically before they become full and might overflow and cause backflow into the toilet that would be connected to the outlet 14. It also is necessary to flush out the black water tank with clean water supplied under pressure to the black water tank. The recreational vehicle typically will have an external connector accessible from outside the vehicle, and the connector can be connected to a hose that supplies the clean water to flush out the black water tank. Inside the recreation vehicle, a hose leads from the external connector to the inlet conduit of a standard vacuum breaker valve such as the inlet 12 of Bejerano FIG. 1 mentioned above. The outlet 14 of the standard vacuum breaker valve is connected to a hose that is connected to the black water tank, thus completing the fluid circuit to supply clean flushing water from the clean water source into the black water tank via the standard vacuum breaker valve 10.

A typical vacuum breaker valve has one or more seals such as the vent seal 28 and the valve seal 26 of Bejerano FIG. 1 mentioned above. Such seals often are made of rubber or the like and prevent leakage of fluid around certain valve parts, some parts moving during operation of the vacuum breaker valve and some remaining stationary. U.S. Pat. No. 10,273,670 to Yontz, which is hereby incorporated herein by this reference for all purposes, discloses another example of a vacuum breaker valve. U.S. Pat. No. 9,719,606 to Yang, which is hereby incorporated herein by this reference for all purposes, also discloses one example of a vacuum breaker valve with a seal in the form of a water stop gasket. However, these seals or gaskets are prone to degrade over time due to wear from repeated operation of the valve and due to environmental conditions such as temperature changes. Once a seal fails, then black water can leak out of the valve and into the interior of the recreational vehicle or back into the toilet.

Unfortunately, there is no advance warning that precedes failure of one of these seals. The owner of the recreational vehicle first learns of a probable seal failure by noticing a visible accumulation of moisture inside the vehicle or by detecting invisible but malodorous smells emanating from inside the vehicle or both. Once the seal has failed, the vacuum breaker valve must be removed and replaced with a new vacuum breaker valve. Because of the typical location of a vacuum breaker valve in an inconspicuous part of the interior of the vehicle that normally is hidden from the occupant's view, removal of a leaking valve and replacement with a new and sealed valve requires fair amounts of time, trouble and effort. Thus, leaking vacuum breaker valves have been a longstanding bane of owners of recreational vehicles, and a solution to this problem is long overdue.

BRIEF DESCRIPTION OF THE DRAWINGS

Aspects and advantages of the invention are set forth below in the following description, or may be obvious from the description, or may be learned through practice of embodiments of the invention. Those of ordinary skill in the art will better appreciate the features and aspects of such embodiments, and others, upon review of the specification. A full and enabling disclosure of the present invention, including the best mode thereof to one skilled in the art, is set forth more particularly in this specification, including reference to the accompanying figures, in which.

Figure 1:
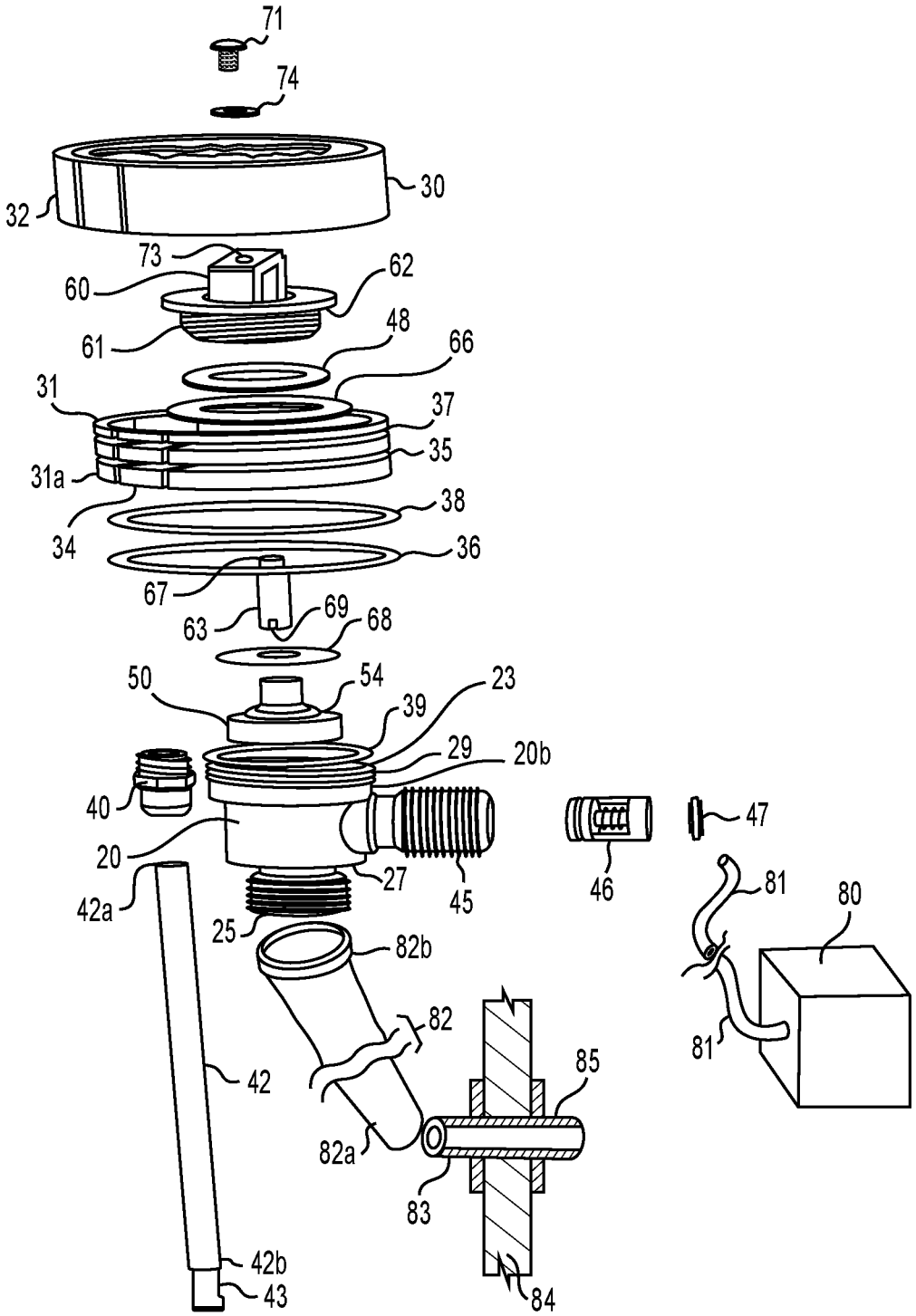
FIG. 1 is an elevated perspective view of an alternative embodiment of the vacuum breaker valve assembly of the present invention in a disassembled, exploded state.

The accompanying drawings, which are incorporated in and constitute a part of this specification, illustrate at least one presently preferred embodiment of the invention as well as features applicable to some alternative embodiments. These drawings, together with the written description, explain the principles of the invention but by no means are intended to be exhaustive of every possible embodiment of the invention.

DETAILED DESCRIPTION OF EXEMPLARY EMBODIMENTS OF THE INVENTION

Reference now will be made in detail to present exemplary embodiments of the invention, wherein one or more examples of which are illustrated in the accompanying drawings. The detailed description uses numerical and/or letter designations to refer to features in the drawings. Like or similar designations in the drawings and description have been used to refer to like or similar parts of the embodiments of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

It is to be understood that the ranges and limits mentioned herein include all sub-ranges located within the prescribed limits, inclusive of the limits themselves unless otherwise stated. For instance, a range from 100 to 1200 also includes all possible sub-ranges, examples of which are from 100 to 150, 170 to 190, 153 to 162, 145.3 to 149.6, and 187 to 1200. Further, a limit of up to 7 also includes a limit of up to 5, up to 3, and up to 4.5, as well as all sub-ranges within the limit, such as from about 0 to 5, which includes 0 and includes 5 and from 5.2 to 7, which includes 5.2 and includes 7.

Figure 2:
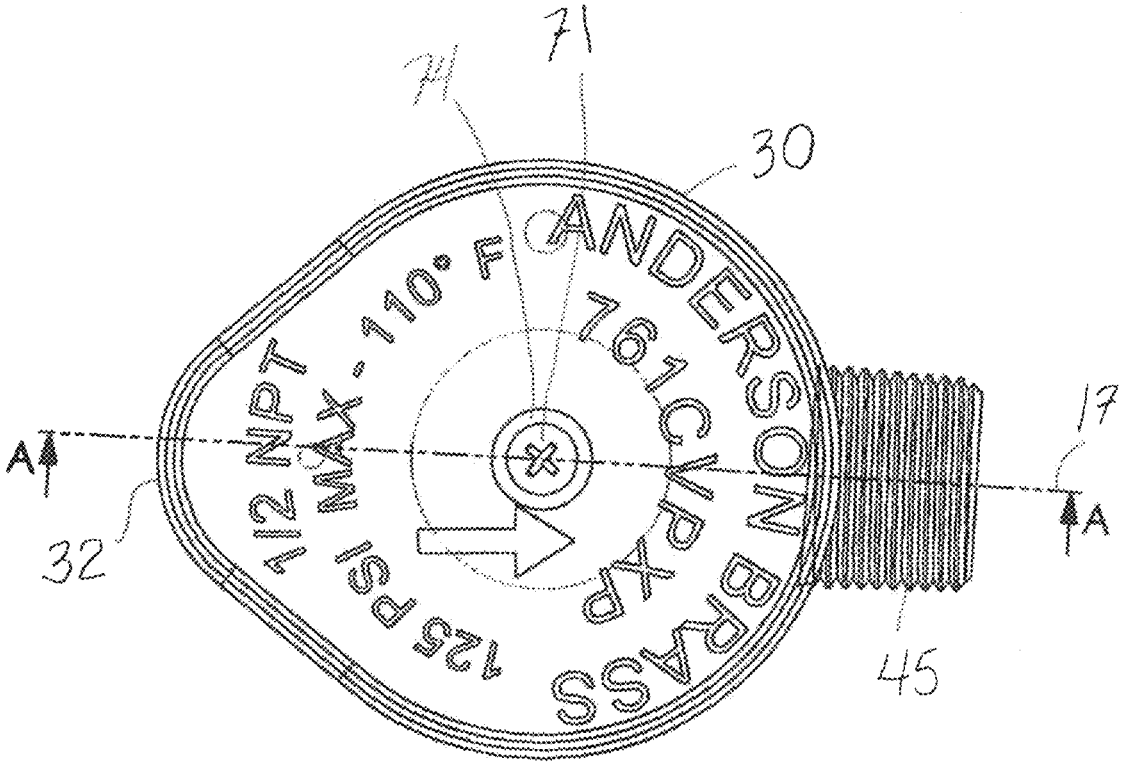
FIG. 2 is a top elevation view of an alternative embodiment of the vacuum breaker valve assembly of the present invention shown in FIG. 1.
Figure 4:
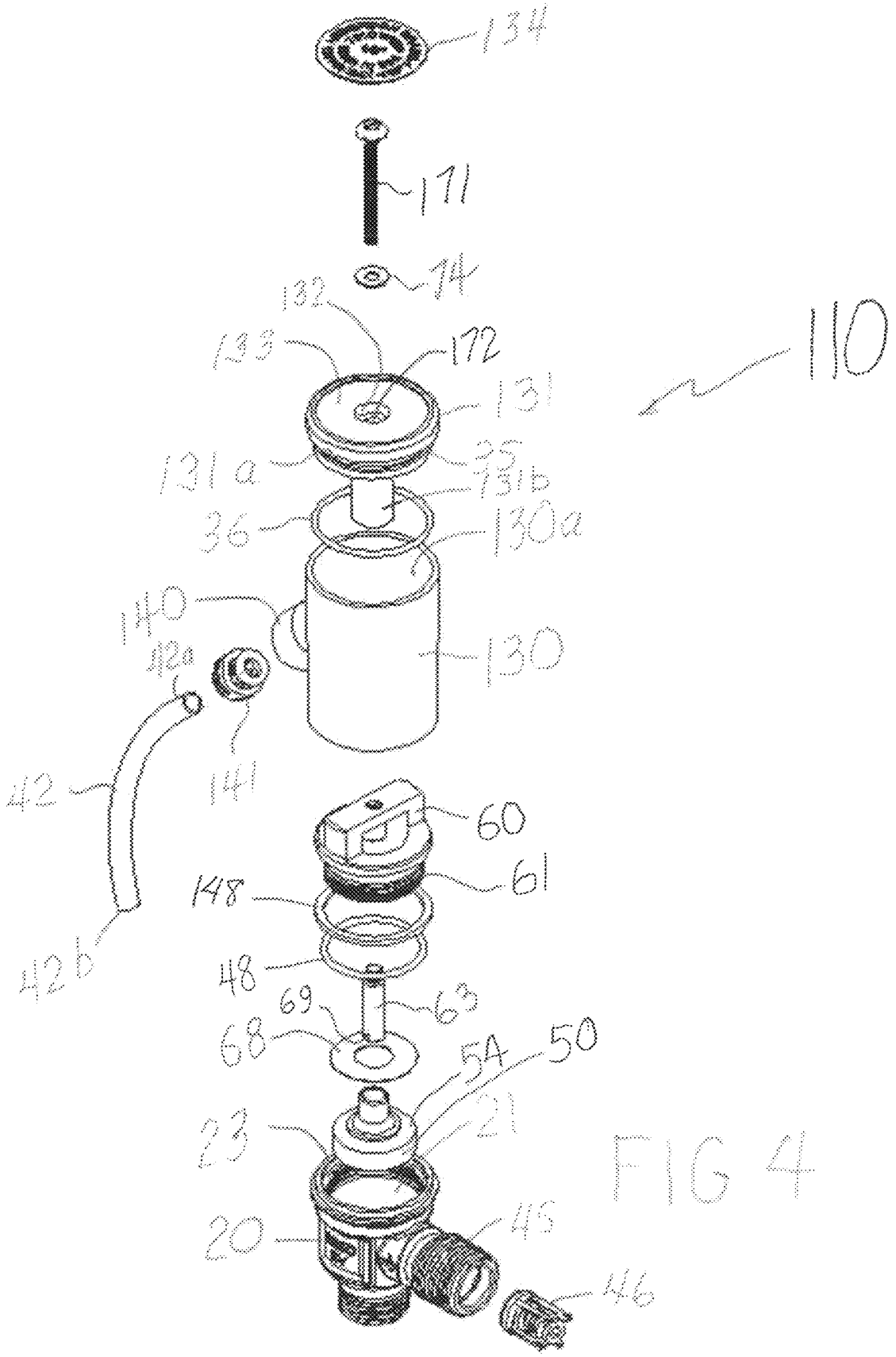
FIG. 4 is an elevated perspective view of a presently preferred embodiment of the vacuum breaker valve assembly of the present invention in a disassembled, exploded state.

FIG. 4 is an elevated perspective view of a disassembled presently preferred embodiment of a vacuum breaker valve assembly 110 of the present invention that includes a valve cap 130, which assumes a relatively elongated cylindrical geometry. FIG. 1 is an elevated perspective view of a disassembled alternative embodiment of a vacuum breaker valve assembly 11 of the present invention that includes a valve cap 30, which assumes a relatively squat tear-drop geometry as shown in FIG. 2. As these two embodiments share many operative components, the same designating numerals will be used throughout the description for these commonly shared components.

Figure 3:
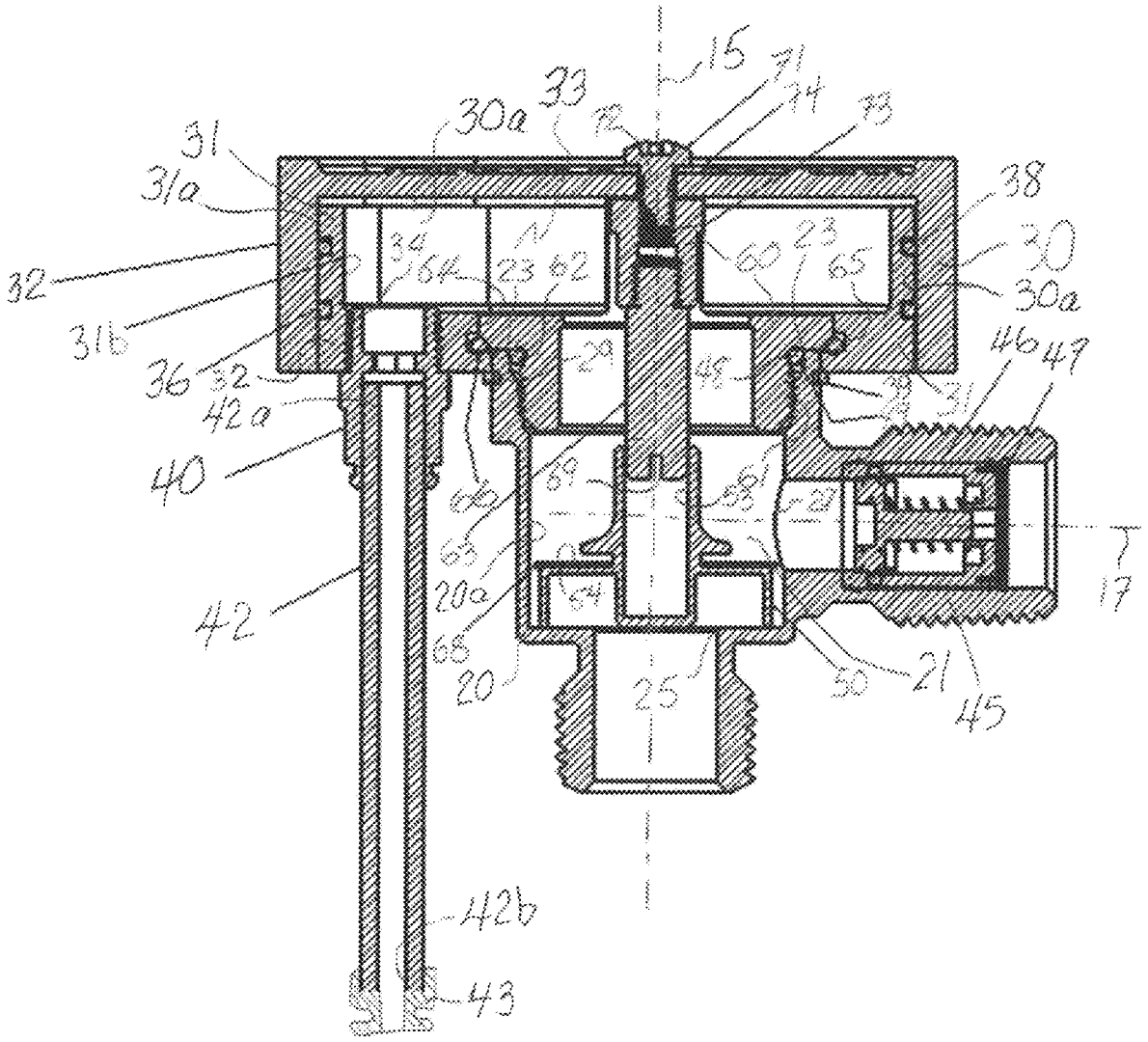
FIG. 3 is a cross-sectional view taken in the plane that contains the lines A-A in FIG. 2 and perpendicular to the plane of FIG. 2 and looking in the direction of the arrows A, A in FIG. 2.
Figure 5:
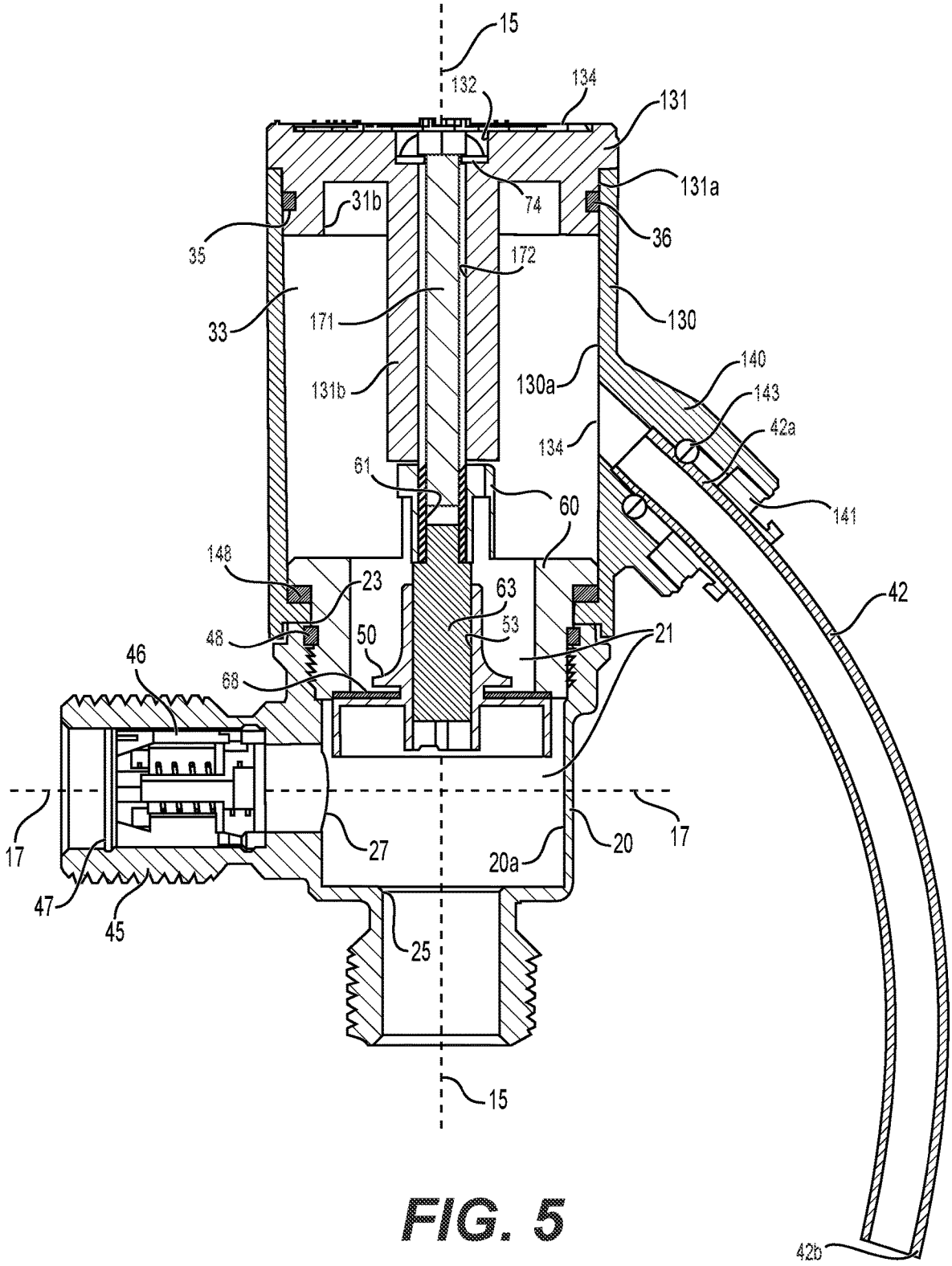
FIG. 5 is a cross-sectional view similar to FIG. 3 but of the assembled presently preferred embodiment of FIG. 4 as if taken in a vertical plane that is similar to the cut plane through the lines A-A in FIG. 2 and perpendicular to the plane of FIG. 2 and looking in the direction of the arrows A, A in FIG. 2.

As shown in FIG. 4, a presently preferred embodiment of the vacuum breaker valve assembly is generally designated by the numeral 110 and includes a valve body 20 defining an exterior surface, which is visible to the viewer in FIG. 4 and in FIG. 5. As shown in FIG. 1, an alternative embodiment of the vacuum breaker valve assembly is generally designated by the numeral 11 and includes a valve body 20 defining an exterior surface, which is visible to the viewer in FIG. 1 and in FIG. 3. As shown in FIG. 3 and in FIG. 5, the valve body 20 defines an interior surface 20*a* opposite the exterior surface.

As shown in FIG. 3 and in FIG. 5, the interior surface 20*a* of the valve body 20 defines a hollow main chamber 21. As shown in FIGS. 1, 3, 4 and 5, the valve body 20 defines a plenum opening 23 into the main chamber 21. As shown in FIGS. 3 and 5, the valve body 20 defines an inlet opening 25 into the main chamber 21. As shown in FIG. 5 for example, the plenum opening 23 is spaced apart along a longitudinal axis 15 from the inlet opening 25. As shown in FIGS. 3 and 5, the valve body 20 defines an outlet opening 27 into the main chamber 21. The outlet opening 27 is defined about a transverse axis 17 that desirably is oriented orthogonally with respect to the longitudinal axis 15. As shown in FIGS. 1, 3 and 5, the vacuum breaker valve assembly 11, 110 of the present invention includes an outlet conduit 45 having one end connected to the outlet opening 27 of the valve body 20 and configured for fluid transmission with the main chamber 21.

As shown in FIGS. 1, 3 and 5, the vacuum breaker valve assembly 11, 110 of the present invention includes a check valve 46, which is disposed internally within the outlet conduit 45 and configured and disposed to permit fluid transmission from the main chamber 21 of the valve body 20 through the outlet conduit 45. Moreover, the check valve 46 is configured and disposed to prevent fluid transmission from the outlet conduit 45 into the main chamber 21 of the valve body 20. As shown in FIGS. 1, 3 and 5, the check valve 46 is held fixed by snap ring 47 against movement along the transvers axis 17 within the outlet conduit 45.

As shown in FIGS. 4 and 5, the presently preferred embodiment of the vacuum breaker valve assembly 110 can include a cylindrically shaped valve cap 130 and a cylindrically shaped cap fixture 131 attached to the proximal end of the valve cap 130. As shown in FIGS. 4 and 5, the valve cap 130 defines an internal surface 130*a*. As shown in FIG. 4, the cap fixture 131 defines an exterior surface 131*a*, which as shown in FIG. 5 is disposed in opposition and against the internal surface 130*a* of the valve cap 130 when the cap fixture 131 is inserted into the proximal end of the valve cap 130 and attached to the valve cap 130.

As similarly shown in FIGS. 1 and 3, an alternative embodiment of the vacuum breaker valve assembly 11 can include a tear drop shaped valve cap 30 and a tear drop shaped cap fixture 31 attached to the valve cap 30. As shown in FIG. 3, the valve cap 30 defines an internal surface 30*a*, and the cap fixture 31 defines an exterior surface 31*a*, which is disposed opposite the internal surface 30*a* of the valve cap 30 when the valve cap 30 is attached to the cap fixture 31. Other alternative embodiments can be configured with other shapes for the valve cap and associated cap fixture, and the transverse cross-sections in a plane extending along the transverse axis 17 can include shapes like polygons such as squares and triangles or shapes with arcuate symmetry like ovals.

As shown in FIGS. 4 and 5, the cap fixture 131 defines a cylindrically shaped exterior surface 131*a* that has a diameter to match the diameter of the internal surface 130*a* of the valve cap 130. As shown in FIGS. 4 and 5, at least a first recessed groove 35 is defined into the periphery of the exterior surface 131*a* of the cap fixture 131. A first sealing gasket 36 is held and received in the first recessed groove 35 and is configured to ensure against fluid leakage where the proximal end of the valve cap 130 is attached to the cap fixture 131.

As similarly shown in FIG. 1 for an alternative embodiment, the cap fixture 31 defines at least a first recessed groove 35 around the periphery of the exterior surface 31*a* of the cap fixture 31. Desirably, in the alternative embodiment depicted in FIG. 1, a second recessed groove 37 is defined around the periphery of the exterior surface 31*a* of the cap fixture 31 and aligned parallel with the first recessed groove 35. Moreover, each of the first recessed groove 35 and the second recessed groove 37 receives therein a respective first sealing gasket 36 and a second sealing gasket 38 that ensures against fluid leakage where the valve cap 30 is attached to the cap fixture 31.

As shown in FIG. 5, the internal surface 130*a* of the valve cap 130 cooperates with the interior surface 131*b* of the cap fixture 131 to define a plenum 33. In the presently preferred embodiment depicted in FIGS. 4 and 5, the first sealing gasket 36 suffices to ensure against fluid leakage from the plenum 33 into the environment that is external to the vacuum breaker valve assembly 11. As similarly shown in FIG. 3, the internal surface 30*a* of the valve cap 30 cooperates with the interior surface 31*b* of the cap fixture 31 to define a plenum 33. Note that the height of the plenum 33 measured along the longitudinal axis 15 in the presently preferred cylindrical embodiment of FIGS. 4 and 5 is taller than the height of the plenum 33 in the tear drop-shaped alternative embodiment of FIGS. 1-3.

The main chamber 21 of the valve body 20 communicates with the plenum 33 via the plenum opening 23 of the valve body 20. As shown in FIG. 5, the valve cap 130 defines a vent opening 134, and the plenum 33 is configured to permit fluid flow between the main chamber 21 of the valve body 20 and the vent opening 134.

In the alternative embodiment shown in a cross-sectional view in FIG. 3, due to the squat configuration of the tear drop embodiment, the cap fixture 31 defines a vent opening 34, and the plenum 33 is configured to permit fluid flow between the main chamber 21 of the valve body 20 and the vent opening 34. In the alternative embodiment of FIGS. 1-3, the first sealing gasket 36 and the second sealing gasket 38 cooperate to ensure against fluid leakage from the plenum 33 into the environment that is external to the vacuum breaker valve assembly 11. In the event of failure of one sealing gasket 36 or 38, then the other sealing gasket 36 or 38 provides redundancy that prevents leakage from the plenum 33.

As shown in FIGS. 1 and 2, each of the valve cap 30 and the cap fixture 31 defines a tear-drop shape when projected onto a plane defined by the transverse axis 17 and a third axis that is orthogonal to both the transverse axis 17 and the longitudinal axis 15. As shown in FIGS. 1 and 3, the vent opening 34 desirably is defined in and through the cap fixture 31 at the narrower portion 32 of the tear-drop shape.

As shown in FIG. 1, the exterior surface 20*b* of the valve body 20 of the vacuum breaker valve assembly 11 desirably defines a retention groove 29, and a snap ring 39 desirably is received in the retention groove 29. The retention groove 29 desirably is disposed close to the plenum opening 23 so that when the snap ring 39 is held in the retention groove 29, the valve body 20 is provided with a resting flange that projects in a direction radially away from the longitudinal axis 15 circumferentially about the periphery of the exterior surface 20*b* of the valve body 20. The cap fixture 31 is disposed and configured to rest against upper surface of the flange provided by the snap ring 39. Desirably, the cap fixture 31 sits against and on one side of the snap ring 39 and is thereby supported by the snap ring 39 along with the valve cap 30.

However, because the presently preferred cylindrical embodiment of the cap fixture 131 has the identical cylindrical symmetry as the valve cap 130, as shown in FIG. 4, there no longer is any need for a snap ring on which to rest the cap fixture 131. As shown in FIG. 5, the distal end of the cap fixture 131 is undercut so as to be disposed and configured to be received into the upper end of the valve cap 130 and has a peripheral shoulder projecting radially from the longitudinal axis 15 and to rest against an upper free edge of the valve cap 130.

As shown in FIGS. 4 and 5, the vacuum breaker valve assembly 110 includes a drainage port 140 that defines a conduit connected to the vent opening 134 of the valve cap 130. Desirably the drainage port 140 is formed as a unitary structure with the valve cap 130 and is configured to receive in the end opposite to the vent opening 134, a quick disconnect fitting 141. As shown in FIG. 5, the quick disconnect fitting 141 is configured to fit around the outer surface of one opposite end 42*a* of an overflow conduit 42, which defines an elongated flexible hollow tube. As shown in FIG. 5, the interior of the drainage port 140 is configured to receive the free end of the end 42*a* of the overflow conduit 42 as well as a groove, which is configured to receive a sealing O-ring 143. As schematically shown in FIG. 1, the second end 42*b* of the overflow conduit 42 desirably has a similar quick disconnect fitting 43 that is configured to be connected to an external flushing port 83 carried on an exterior wall 84 of the recreational vehicle and connected in fluid communication with a connection fixture 85 that is accessible from outside the recreational vehicle. In this way, the external flushing port 83 of the recreational vehicle desirably would be open to atmosphere in the immediate environment external to the recreation vehicle. Thus, the plenum 33 likewise would be at essentially atmospheric pressure via the drainage port 140 in the valve cap 130.

As shown in FIGS. 1 and 3, the alternative embodiment of the vacuum breaker valve assembly 11 includes a drainage plug 40 connected to the vent opening 34 of the cap fixture 31. Desirably the drainage plug 40 defines a screw-threaded exterior surface that is configured to be screwed into a complementary mating screw-threaded surface defined in the vent opening 34 of the cap fixture 31. Though not shown in FIG. 3, the drainage plug 40 desirably is configured with a groove that receives therein a sealing O-ring.

As shown in the alternative embodiment of FIGS. 1 and 3, the vacuum breaker valve assembly 11 desirably includes an overflow conduit 42, which defines an elongated flexible hollow tube that has a first end 42*a* connected to the drainage plug 40. The overflow conduit 42 has a second end 42*b* opposite the first end 42*a*. As shown in FIG. 3, the second end 42*b* desirably has a fitting 43 that is configured to be connected to the external flushing port 83 carried on the exterior wall 84 of the recreational vehicle. The external flushing port 83 of the recreational vehicle desirably would be open to atmosphere in the immediate environment external to the recreation vehicle. Thus, the plenum 33 likewise would be at essentially atmospheric pressure.

As shown in FIGS. 1, 3, 4 and 5, the vacuum breaker valve assembly 11 includes a float 50 that is disposed within the main chamber 21. The float 50 is configured and disposed to move between a closed position and an open position. In the open position of the vacuum breaker valve assembly 11, 110, the float 50 is disposed to permit fluid to flow into the lower section of the main chamber 21 from the inlet opening 25 and out of the lower section of the main chamber 21 through the outlet opening 27 and past the check valve 46. The open disposition of the float 50 is schematically shown in FIG. 5, which schematically shows how this open disposition of the float 50 serves to prevent fluid flow from the inlet opening 25 from traveling past the plenum opening 23 and reaching into the plenum 33 after passing into and through the upper section of the main chamber 21. Accordingly, when the float 50 is disposed in its open orientation shown in FIG. 5 for example, the float 50 in effect closes the plenum opening 23. Thus, when the float 50 is moved into the open position, the vacuum breaker valve assembly 11 becomes opened to fluid flow through the valve body 20 from the inlet opening 25 into the lower section of the main chamber 21 and out of the main chamber 21 through the outlet opening 27, but not fluid flow through the valve body 20 from the inlet opening 25 into the plenum 33.

Conversely, when the float 50 moves into the closed orientation as shown schematically in FIG. 3 for example, then the float 50 is disposed to close the inlet opening 25 while permitting fluid flow from the outlet opening 27 through the main chamber 21 and out of the plenum opening 23. In the closed position of the vacuum breaker valve assembly 11, 110, any fluid flowing into the plenum 33 will drain through the vent opening 24, 134 and into the overflow conduit 42, from which the fluid is carried to the external flushing port 83 (FIG. 1) carried on the exterior wall 84 of the recreational vehicle and thus outside of the recreational vehicle.

As shown in the embodiment of FIGS. 1, 3, 4 and 5, the vacuum breaker valve assembly 11, 110 includes a retainer 60 attached via a threaded connection to the valve body 20 and disposed between the plenum opening 23 and the inlet opening 25. The exterior surface of a first end of the retainer 60 defines a screw-threaded surface 61, which is configured to mate with a screw-threaded portion of the interior surface 20*a* of the valve body 20 disposed proximate to the plenum opening 23. The exterior surface of the retainer 60 is configured to receive a sealing gasket 48 that is configured and disposed to seal against the valve body 20 around the plenum opening 23 and thereby prevent passage of fluid between the valve body 20 and the retainer 60 where the retainer 60 is attached to the valve body 20. As shown in FIG. 5, a sealing gasket 148 is inserted between opposing flanges of the valve cap 130 and the retainer 60 to prevent fluid leakage at the interface that connects the retainer 60 to the valve cap 130.

Desirably, as shown for the presently preferred embodiment depicted in FIG. 5, a bolt 171 defines a shaft that elongates parallel to the longitudinal axis 15 and has at its distal end thereof, a screw-threaded exterior surface. A screw head is defined at the proximal end that is opposite the distal end of the shaft of the bolt 171. The screw-threaded distal end of the bolt 171 is screwed into the retainer 60 after the shaft has passed through a central conduit 172 defined longitudinally through an elongated finger portion 131*b* of the cap fixture 131. Additionally, as shown in FIG. 5, the cap fixture 131 defines a countersunk deep recess 132 that receives a washer 74, which is disposed between the cap fixture 131 and the underside of the screw head on the end of the shaft of the bolt 171. When the screw-threaded exterior surface of the distal end of the bolt 171 is screwed into the proximal end of the retainer 60, the bolt 171 joins together the cap fixture 131, the valve cap 130 and the retainer 60.

As shown in FIG. 5, the valve body 20 is internally screw-threaded in the vicinity of plenum opening 23. The exterior surface of the distal end of the retainer 60 is screw-threaded to complement the internally screw-threaded surface of the valve body 20 so that the retainer 60 can be screwed into the valve body 20. In this way, the valve body 20 is connected to the retainer 60, which in turn is connected via the bolt 171 to the cap fixture 131 and the valve cap 130, thereby completing assembly of the vacuum breaker valve assembly 110.

As shown in FIGS. 1 and 3, the alternative embodiment of the valve cap 30 and cap fixture 31 attached thereto are attached to the retainer 60 by a screw 71 that passes through a hole 72 defined through the upper wall of the valve cap 30 and screwed into a threaded bore 73 formed in the upper end of the retainer 60. Desirably, the screw 71 passes through a washer 74 that sits in a countersunk region surrounding the hole 72 on the external surface of the valve cap 30 and between the head of the screw 71 and the external surface of the valve cap 30.

As shown for the alternative embodiment depicted in FIG. 1, the cap fixture 31 internally defines a retainer opening 64 that receives therein the retainer 60. As shown in FIG. 3, the retainer 60 projects through the retainer opening 64 into the plenum 33. As shown in FIG. 3, the surface of the cap fixture 31 defining the retainer opening 64 desirably is provided with a recessed groove 65 that receives therein a sealing gasket 66 that is configured and disposed to seal against a peripheral edge of the retainer 60 and thereby prevent passage of fluid between the peripheral edge of the retainer 60 and the retainer 60 opening of the cap fixture 31 of the valve cap 30.

As shown in FIGS. 1, 3, 4 and 5, a guide post 63 that elongates along the longitudinal axis 15 has a screw-threaded end that is screwed into the retainer 60. In the embodiments shown, the guide post 63 is a separate element from the retainer 60, which defines the screw-threaded surface 61. As shown in FIG. 1, a forward end 67 of the guide post 63 is provided with an externally threaded surface configured to be screwed into the end of the main body portion of the retainer 60 that is opposite the end having the screw-threaded surface 61. As shown in FIG. 1, a rear end of the guide post 63 is opposite the forward end 67 and provided with a slot 69 that facilitates receiving a tool for engaging the guide post 63 to be screwed into the main body portion of the retainer 60 during assembly of the vacuum breaker valve assembly 11.

As shown in FIGS. 3 and 5, the float 50 internally defines a guide channel 53 that is configured to receive the guide post 63 and move in a sliding fashion with respect to and along the guide post 63. As shown in FIG. 4, the float 50 defines an upper shoulder 54 disposed facing the retainer 60 and the valve cap 130. As shown in FIG. 3, the upper shoulder 54 of the float 50 is disposed facing the valve cap 30.

As shown in FIGS. 1, 3, 4 and 5, the vacuum breaker valve assembly 11, 110 includes a resilient sealing gasket 68 carried on the upper shoulder 54 of the float 50 and configured and disposed to seal against the retainer 60 when the float 50 assumes the open position. Because of repetitive movement of the float 50, it is this particular sealing gasket 68 that is most prone to wear and eventually fail to seal. However, the present invention prevents such failure from having deleterious effects inside the recreational vehicle in which the vacuum breaker valve assembly 11, 110 is installed.

As shown in FIG. 4, a countersunk shallow recess 133 is defined into the proximal end of the cap fixture 131. The countersunk shallow recess 133 is configured to receive therein, a thin label 135 that has an underside that attaches by adhesive to the cap fixture 131 and covers and seals the head of the bolt 171 in the countersunk deep recess 132. The exposed upper side of the label 135 can be provided with various identifying indicia, such as the date when a new sealing gasket 68 was last installed in the vacuum breaker valve assembly 110. The label can be removed manually when it becomes necessary to disassemble the vacuum breaker valve assembly 110 to replace any worn out and failing sealing gasket 36, 48, 148, 68. Moreover, the label 135 desirably is made of metal such as aluminum so that peeling away the label 135 to remove the label 135 from the countersunk shallow recess 133 leaves tell-tale signs in the label 135 that the label 135 has been removed or otherwise tampered with. Accordingly, any attempt to reuse a once-removed label 135 would bear such tell-tale signs as evidence of having once been removed. In this way, it is easy to discern whether there has been any tampering with the vacuum breaker valve assembly 110 and requires a new label 135 when a new sealing gasket is installed.

Once assembled, the vacuum breaker valve assembly 11, 110 would be installed in the interior wall space of a recreational vehicle for example. As schematically shown in FIG. 1, a first flexible hose 81 would have one end connected to a black water storage tank 80 of the recreational vehicle. While the opposite end of the first flexible hose 81 would be connected to enable fluid communicate through the outlet opening 27 of the valve body 20 of the vacuum breaker valve assembly 11, 110 to create a path for fluid transmission between the vacuum breaker valve assembly 11, 110 and the black water storage tank 80.

A second flexible hose 82 would have one end connected to the external flushing port 83 carried on an exterior wall 84 of the recreational vehicle. The external flushing port 83 desirably is mounted to the external wall 84 of the recreational vehicle with a connection fixture 85 accessible from outside the vehicle. The external flushing port 83 desirably is configured to permit connection to a supply of fresh water that can be supplied under pressure to flow through the flushing port 83. The opposite end of the second flexible hose 82 would be connected to the inlet opening 25 of the valve body 20 of the vacuum breaker valve assembly 11, 110 to create a path for fluid transmission between the vacuum breaker valve assembly 11, 110 and the supply of fresh water arriving under pressure thorough the flushing port 83.

The pressurized flow of fresh water into the inlet opening 25 of the valve body 20 would propel the float 50 into the open position and permit fresh water to flow into the main chamber 21 and exit through the outlet opening 27 and then through the first flexible hose 81 and into the black water storage tank 80 to perform the flushing operation on the black water storage tank 80. The recreation vehicle would have an external flushing port 83 through the floor of the vehicle that discharges into the outside environment of the vehicle. The fitting 43 on the second end 42*b* of the overflow conduit 42 as schematically shown in FIG. 1 for example, would be connected to the external flushing port 83 to create a path for fluid transmission between the drainage plug 40 and the drainage opening of the recreational vehicle. Desirably the vacuum breaker valve assembly 11, 110 would be disposed at a higher elevation in the vehicle than the location of the external flushing port 83 to take advantage of gravitational assist in promoting the flow of fluid from the plenum 33 of the vacuum breaker valve assembly 11 to the external flushing port 83 of the vehicle. In this way, there is created a path for fluid transmission between the plenum 33 of the vacuum breaker valve assembly 11, 110 and the exterior of the recreational vehicle.

Once properly installed in the recreational vehicle, the vacuum breaker valve assembly 11, 110 of the present invention would protect the interior of the recreational vehicle against any failure of any of the valve gaskets 35, 36, 38, 48, 148, 66, 68 prone to wear and degradation. Movement of the float 50 up and down along the guide post 63 subjects the sealing gasket 68 in particular to wear. Such failure would not cause fluid to leak from the vacuum breaker valve assembly 11, 110 and either despoil the interior of the recreation vehicle in the immediate vicinity of the vacuum breaker valve assembly 11, 110 or back up fluid from the black water tank 80 into toilets inside the recreation vehicle. Rather than leak through the seals 35, 36, 38, 48, 66, 68 inside the vacuum breaker valve assembly 11, 110 the fluid would have a ready-made path of least resistance into the plenum 33 and thence away from the plenum 33 through the overflow conduit 42 and discharge harmlessly outside the recreational vehicle. Moreover, as soon as the vehicle's operator detects discharge beneath the external flushing port 83, the operator would be alerted to the need to replace the vacuum breaker valve 11, 110 connected to the external flushing port 83.

What is claimed is:

1. A vacuum breaker valve assembly, comprising:

a valve body defining an exterior surface and an interior surface opposite the exterior surface, wherein the interior surface defines a hollow main chamber, the valve body defining a plenum opening into the main chamber, the valve body defining an inlet opening into the main chamber, and the valve body defining an outlet opening into the main chamber;

a valve cap attached to the valve body, the valve cap defining an external surface and an internal surface opposite the external surface, wherein the internal surface defines a plenum and the plenum opening of the valve body connects the main chamber to the plenum, wherein the valve cap defining a vent opening, wherein the plenum is configured to permit fluid flow between the plenum opening of the valve body and the vent opening of the valve cap;

a drainage plug connected to the vent opening of the valve cap;

a float disposed within the main chamber and disposed to move between a closed position and an open position, wherein in the open position the float is disposed to close the plenum opening and permit fluid flow through the inlet opening into the main chamber and out of the main chamber through the outlet opening, wherein in the closed position the float is disposed to close the inlet opening and permit fluid flow from the outlet opening through the main chamber and out of the plenum opening;

an outlet conduit having one end connected to the outlet opening of the valve body and configured for fluid transmission with the main chamber; and a check valve fixed internally within the outlet conduit and configured and disposed to permit fluid transmission from the main chamber through the outlet conduit and configured and disposed to prevent fluid transmission into the main chamber from the outlet conduit.

2. The vacuum breaker valve assembly of claim 1, further comprising:

a retainer attached to the valve body and disposed between the plenum opening and the inlet opening, wherein the plenum opening is spaced apart along a longitudinal axis from the inlet opening, wherein the valve cap is attached to the retainer;

a guide post having one end connected to the retainer and that elongates along the longitudinal axis, wherein the float defines a guide channel that is configured to receive the guide post and move in a sliding fashion with respect to and along the guide post, wherein the float defines an upper shoulder disposed facing the valve cap; and a resilient sealing ring carried on the upper shoulder of the float and configured and disposed to seal against the retainer when the float assumes the open position.

3. The vacuum breaker valve assembly of claim 1, further comprising an overflow conduit defining an elongated flexible hollow tube having one end connected to the drainage plug.

4. The vacuum breaker valve assembly of claim 1, further comprising a cap fixture connected to the valve cap, the cap fixture defining a proximal end and a distal end disposed apart from the proximal end along the longitudinal axis, the cap fixture defining a central conduit extending axially through the cap fixture along the longitudinal axis, the proximal end of the cap fixture defining a countersunk shallow recess configured to receive therein a thin label that can be adhesively attached to the cap fixture to cover the central conduit.

5. The vacuum breaker valve assembly of claim 4, further comprising a thin label that is disposed in the countersunk shallow recess and adhesively attached to the cap fixture so as to cover the central conduit.

6. The vacuum breaker valve assembly of claim 4, wherein the cap fixture defines a countersunk deep recess that surrounds where the central conduit connects to the countersunk shallow recess.

7. The vacuum breaker valve assembly of claim 6, further comprising:

a retainer having a proximal end and a distal end spaced apart along the longitudinal axis from the proximal end and attached to the valve body;

a washer disposed in the countersunk deep recess; and a bolt having a proximal end and a distal end opposite the proximal end, wherein the proximal end of the bolt defines a head resting on the washer, wherein the distal end of the bolt defines a threaded outer surface that is screwed into the proximal end of the retainer.

8. The vacuum breaker valve assembly of claim 7, further comprising a thin label that is disposed in the countersunk shallow recess and adhesively attached to the cap fixture so as to cover the head of the bolt.

* * * * *